US007003806B1

(12) United States Patent
Kleinert et al.

(10) Patent No.: US 7,003,806 B1
(45) Date of Patent: Feb. 28, 2006

(54) GLOVE WITH STICK CONTROLLER PADDING

(75) Inventors: James M. Kleinert, Louisville, KY (US); Dave L. T. Wilcox, Lucan (CA); David M. Timbeck, London (CA)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 10/847,187

(22) Filed: May 17, 2004

(51) Int. Cl.
*A41D 19/00* (2006.01)

(52) U.S. Cl. ..... 2/159; 2/161.6

(58) Field of Classification Search ..... 2/16, 2/18, 19, 20, 159, 160, 161.1, 161.2, 161.6; 602/21
See application file for complete search history.

(56) References Cited

U.S. PATENT DOCUMENTS

| | | | | | |
|---|---|---|---|---|---|
| 1,525,298 | A | | 2/1925 | Hartman | |
| 2,258,999 | A | * | 10/1941 | Nunn | 2/159 |
| 4,068,312 | A | | 1/1978 | Ledesma | |
| 4,201,203 | A | | 5/1980 | Applegate | |
| 4,272,850 | A | | 6/1981 | Rule | |
| 4,287,885 | A | | 9/1981 | Applegate | |
| 4,329,741 | A | * | 5/1982 | Bach | 2/161.2 |
| 4,546,495 | A | * | 10/1985 | Castillo | 2/161.1 |
| 4,748,690 | A | * | 6/1988 | Webster | 2/161.1 |
| 5,168,576 | A | | 12/1992 | Krent et al. | |
| D338,280 | S | | 8/1993 | Krent et al. | |
| D360,284 | S | | 7/1995 | Paffett et al. | |
| 5,471,682 | A | * | 12/1995 | Robins et al. | 2/161.1 |
| 5,477,558 | A | | 12/1995 | Volker et al. | |
| 5,500,955 | A | | 3/1996 | Gongea | |
| 5,581,809 | A | * | 12/1996 | Mah | 2/20 |
| 5,785,617 | A | | 7/1998 | MacKay, Jr. | |
| 5,815,839 | A | * | 10/1998 | Safford | 2/161.1 |
| 6,098,200 | A | * | 8/2000 | Minkow et al. | 2/161.1 |
| 6,216,276 | B1 | * | 4/2001 | Eibert | 2/161.2 |
| 6,233,744 | B1 | * | 5/2001 | McDuff | 2/161.1 |
| 6,253,382 | B1 | | 7/2001 | Kleinert | |
| 6,389,601 | B1 | | 5/2002 | Kleinert | |
| 6,453,474 | B1 | | 9/2002 | Kleinert | |
| 6,502,244 | B1 | | 1/2003 | Kleinert | |
| 6,584,616 | B1 | | 7/2003 | Godshaw et al. | |
| 6,701,530 | B1 | | 3/2004 | Kleinert | |
| 6,708,346 | B1 | * | 3/2004 | Terris et al. | 2/161.2 |
| 2003/0050586 | A1 | | 3/2003 | Domanski et al. | |

* cited by examiner

*Primary Examiner*—Gary L. Welch
(74) *Attorney, Agent, or Firm*—Charles G. Lamb; Middleton Reutlinger

(57) ABSTRACT

A stick controller for a glove, particularly a hockey glove, includes a padded wedge of a generally trapezoidal shape to cover the palm side of the hand to stabilize a hockey stick or the like which fits within the palm of the hand. The pad is preferably above the radiocarpal joint of the wrist and below the center axis of rotation of the metacarpalphalangeal joints overlying the carpometacarpal joints of the long finger, the ring finger and the small finger.

11 Claims, 4 Drawing Sheets

GLOVE WITH STICK CONTROLLER PADDING

BACKGROUND OF THE INVENTION

This invention relates to gloves for the human hand which are worn when playing or working wherein a stick or tool, such as a hockey stick or the like, is held within the hand of the wearer. More particularly, the present invention relates to a glove having padding therein for controlling and maintaining the stick or tool in a steady condition when in use.

Glove construction for protection of the human hand is well known. In addition, there are a number of patents which teach gloves with padding therein to protect the hand and particularly, the fingers, when in use. Moreover, there have been gloves specifically designed to assist in the natural movement of a human hand when handling a hockey stick. For example, U.S. Pat. No. 6,233,744 teaches a pair of gloves wherein one of the gloves has a structure formed and angulated to define a shape adapted to the position in which a hockey stick is held. There also have been gloves proposed in the play of golf which include pads therein specifically adapted to receive the handle of a golf club therebetween. For example, U.S. Pat. No. 4,329,741 teaches a golf glove having a pair of spaced pads secured along the palm portion of the golf glove which extend diagonally thereacross at an angle with respect to the fingers portion so as to create a diagonally disposed valley to receive the handle of a golf club therein. U.S. Pat. No. 5,471,682 teaches a batting glove having a raised ridge or pad which faces the bat away from the "V" of the thumb to free the wrist of the upper hand on the bat to enable full wrist movement in swinging a bat.

SUMMARY OF THE INVENTION

It is an object of the present invention to provide a glove for use with a stick or tool designed for play or work in a specific sport or task.

It is another object of the present invention to provide a hockey glove with padding added to selected areas of the glove for maintaining a hockey stick in a stabilized condition during use.

It is a further object of the present invention to provide a sports glove to protect selected anatomically parts of the hand while using a stick therein which is subjected to use in striking of an object such as a hockey puck or the like.

More particularly, the present invention provides a glove which includes a shock absorbing pad of generally trapezoidal shape positioned for location below the center axis of rotation of the metacarpalphalangeal joints and overlying the carpometacarpal joints of the long finger, the ring finger and the small finger of the hand.

Further objects and advantage of the present invention will appear from the following description and appended claims, reference being had to the accompanying drawings forming a part of the specification wherein like reference characters designate corresponding parts into several views.

DETAILED DESCRIPTION OF THE PREFERRED EMBODIMENT

Figure 1:
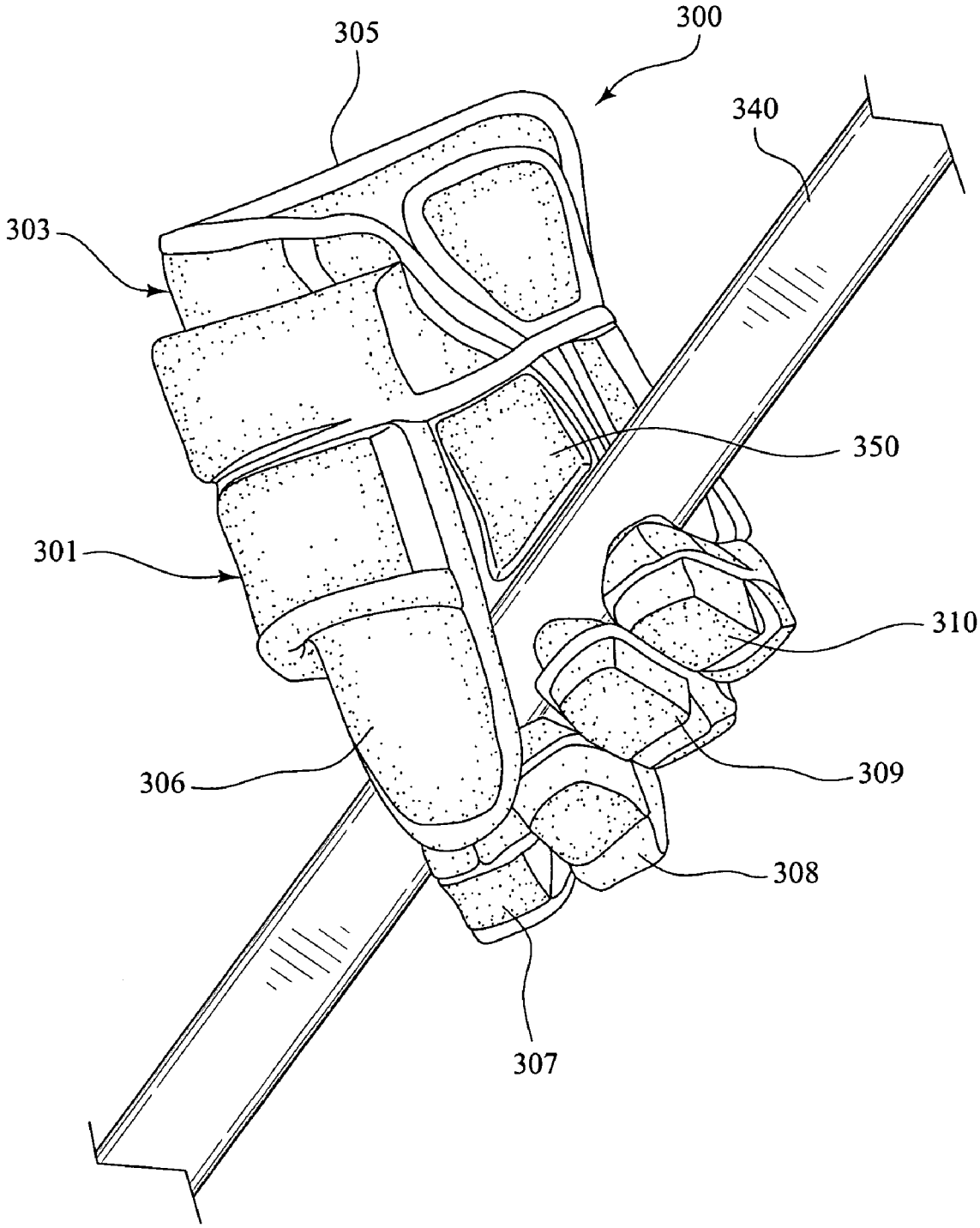
FIG. 1 is a perspective view of a sports glove of the present invention.
Figure 3:
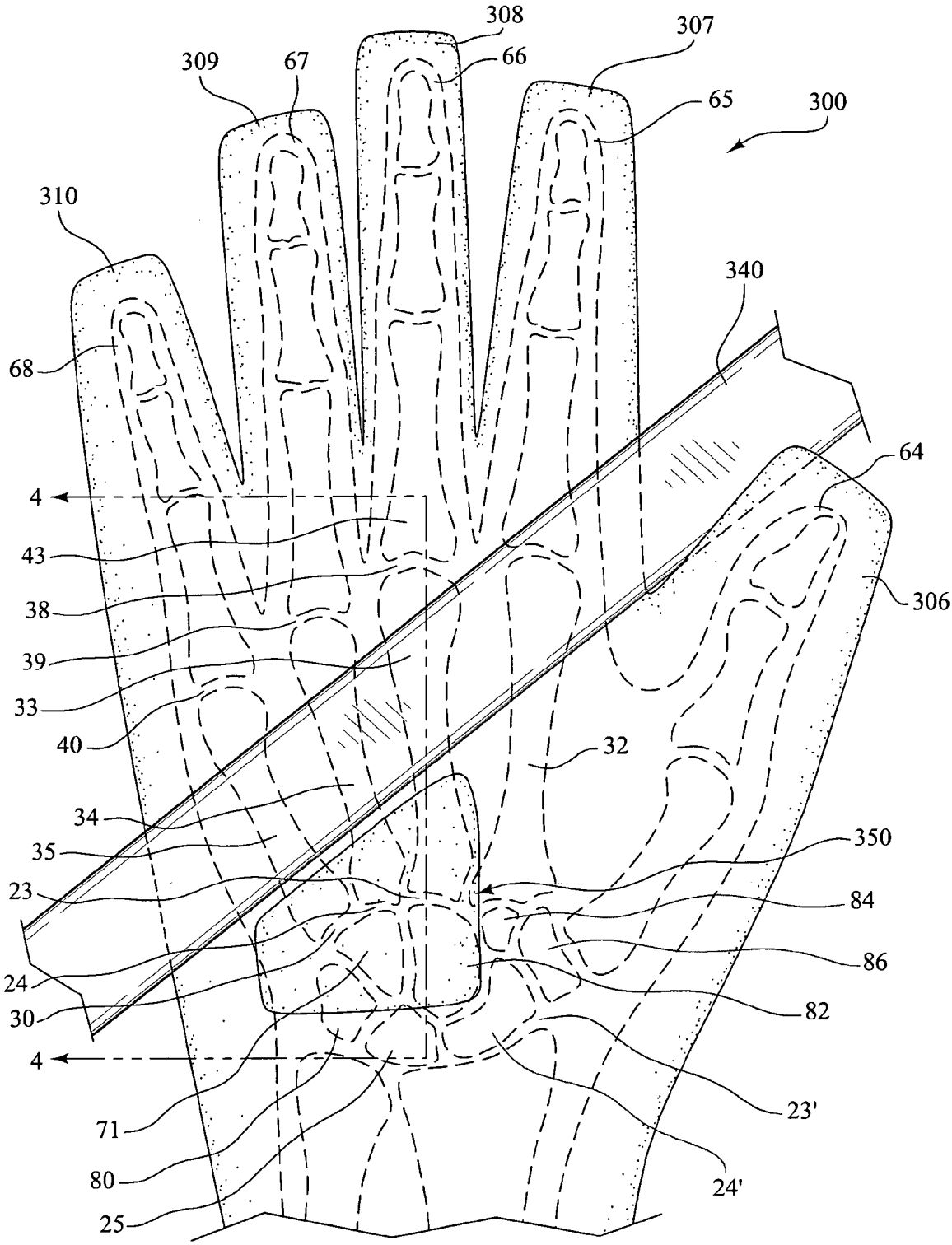
FIG. 3 is a preferred embodiment of the glove of FIG. 1 showing the palmar side details and seen overlaying the skeletal structure of a right palm side hand when in A use condition; and, FIG. 4 is a sectional view taken along line 4—4 of FIG. 3.

A sports glove, particularly useful for playing hockey identified by the numeral 300, is shown in FIG. 1. The glove 300 includes a hand receiving portion 301 and a wrist receiving portion 303 with an opening 305 for insertion of the hand and wrist therein. The hand receiving portion 301 includes a thumb portion 306, an index finger portion 307, a long finger portion 308, a ring finger portion 309, and a small finger portion 310. Portions 307, 308, 309 and 310 are adapted to enclose the index finger 65, long finger 66, ring finger 67, and small finger 68 (FIG. 3). Thumb portion 306 is adapted to enclose thumb 64 (FIG. 3). Protective pad segments may be provided, as deemed necessary, to protect individual fingers, the thumb, and wrist separately with appropriate flexion zones that facilitate natural movements of the hand. Such pads are shown and described in, for example, U.S. Pat. No. 6,453,474.

Figure 2:
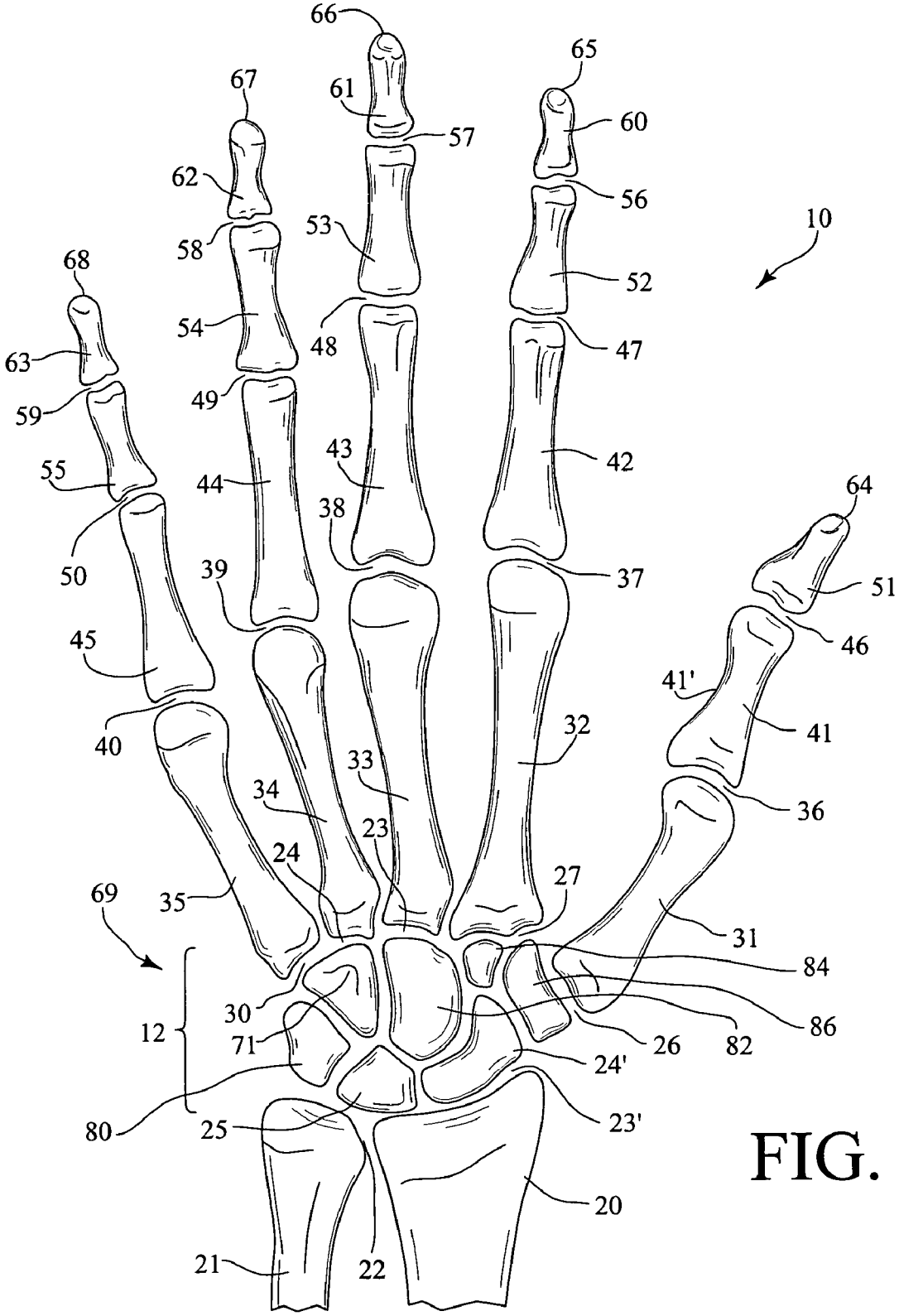
FIG. 2 is a schematic anatomical view of a right human hand showing the palm side detail.

FIG. 2 is a schematic anatomical view of the bones of a right human hand 10 looking at a palm side. Shown are the radius 20, ulna 21, radiocarpal joint (RC) 23', distal radio ulnar joint (DRUJ) 22, wrist 12, thumb 64, index finger 65, long finger 66, ring finger 67, and small finger 68. The carpus comprises eight carpal bones, seven of which are shown in FIG. 2 and includes the hamate bone 71 with its hook-like protrusion, the scaphoid 24', the lunate 25, triquetrum 80, capitate 82, trapezoid 84, and trapezium 86.

The thumb 64 is comprised of the distal phalanx 51, the interphalangeal joint (IP) 46, proximal phalanx 41, diaphysis of proximal phalanx 41', metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small finger 68 is comprised of the distal phalanx 63, distal interphalangeal joint (DIP) 59, middle phalanx 55, proximal interphalangeal joint (PIP) 50, proximal phalanx 45, metacarpalphalangeal joint (MCP) 40, metacarpal 35, and carpometacarpal joint (CMC) 30.

Figure 4:
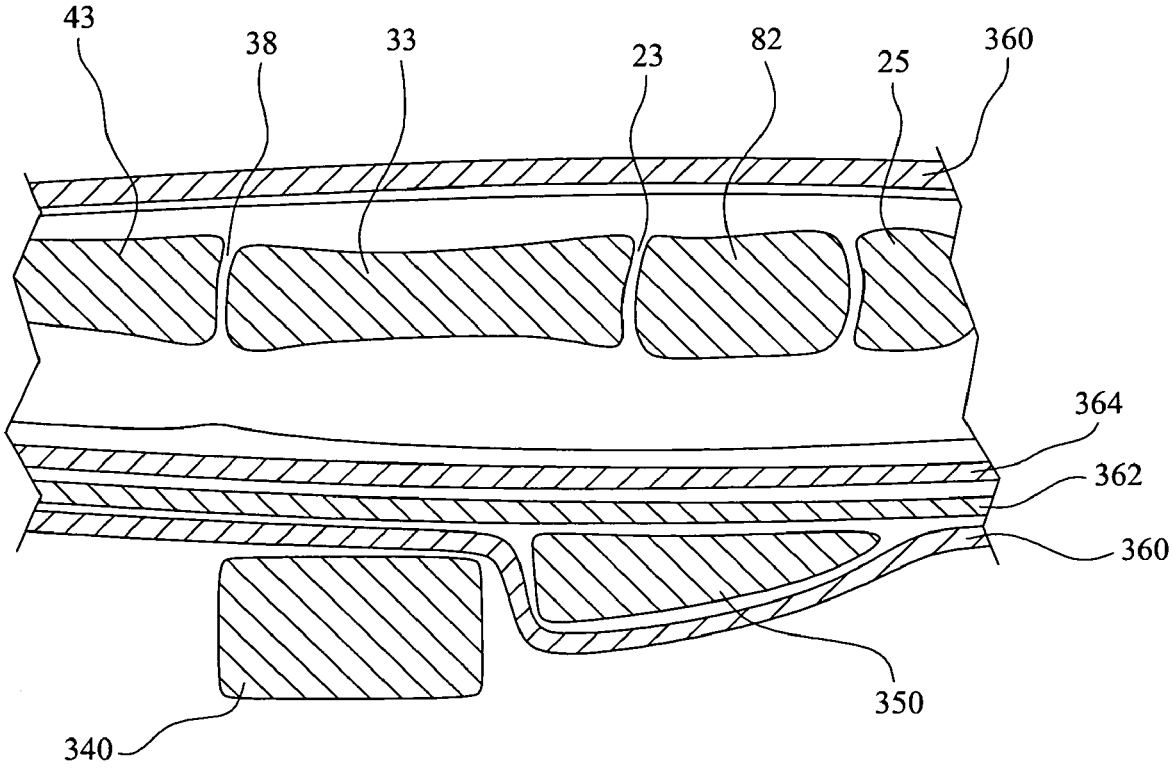

As best shown in FIGS. 3 and 4, a stick 340, such as a hockey stick or any other type of stick used in a game for contacting an object, such as a hockey puck or the like, is positioned within a glove 300 so that the wearer of the glove can control the stick 340 when in contact with a moving object. A shock absorbing padding 350 is positioned to cover selected areas of the palm of the hand and at the same time provide for positioning the stick in the proper alignment for use.

As best shown in FIG. 4, the glove 300 includes an outer covering 360 which may be of either unitary construction or include a plurality of sections to cover the hand and the individual thumb and finger portions 306, 307, 308, 309 and 310 for the thumb and fingers, respectively. The glove covering is made of any suitable material known in the art, such as leather, or the like. Between the fingers and the outer covering 360 is generally a plurality of layers of inner coverings, identified by the numerals 362 and 364 wherein other types of padding (not shown) may be inserted therebetween to protect selected tendons and pulleys of the fingers as well as other portions of the human hand. Generally, the sports glove 300 includes the inner covering 362 which is sized to cover the palm, thumb and fingers of a human hand and in conjunction with the outer covering 360 which covers a back, thumb and fingers of a human hand enclose the shock absorbing pad 350 therein.

As best shown in FIG. 3, the shock absorbing pad 350 is of trapezoidal shape and is positioned for location below the center axis of rotation of the metacarpal joints 38, 39 and 40 and overlying the carpalmetacarpal joints of the long finger 55, the ring finger 67, and the small finger 68, respectively. Moreover, the shock absorbing pad 350 generally covers at least a portion of the triquetrum 80, the hamate 71, the capitate 82 and the lunate 75 of the hand. Usually, the trapezium 36, the trapezoid 84 and the scaphoid 24' of the human hand are absent of the shock absorbing pad 350. Furthermore, the shock absorbing pad 350 is above the radiocarpal joint 23'. In a preferred embodiment the shock absorbing pad 350 is approximately 4 cms below the center axis of rotation of the metacarpalphalangeal joints. Moreover, trapezoidal shaped pad 350, as shown in FIG. 3, has a long side or distal edge that extends just above the proximal ends of the metacarpals 33, 34, 35 of the long finger, ring finger, and small finger, respectively. This distal edge of the pad 350 provides a ridge or stabilizing pad for a hockey stick when the fingers are curled around the stick in a use condition. In other words, when the fingers are in a curled condition, in combination with this distal edge of the trapezoidal shaped shock absorbing or stabilizing pad 350, a valley is provided across the mid-portions of the metacarpals for receipt of a hockey stick or the like therein.

It is realized that even though the preferred embodiment has been directed to a sports glove for use in the play of hockey, other uses for gloves containing the unique padding arrangement of the present invention are intended to be included.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A glove comprising:

a covering sized to cover the palm, back, thumb, fingers of a human hand and a shock absorbing pad;

said shock absorbing pad covering a portion of the palm of the hand and being of generally trapezoidal shape, said shock absorbing pad being positioned for location below the center axis of rotation of the metacarpalphalangeal joints and overlaying the proximal ends of the metacarpals and the carpometacarpal joints of a long finger, a ring finger, and a small finger of the hand, the shock absorbing pad having a distal edge that extends just above the proximal ends of the metacarpals, of the long finger, the ring finger, and the small finger.

2. The glove of claim 1 wherein the trapezium, trapezoid and scaphoid of said human hand are absent of said shock absorbing pad.

3. The glove of claim 1, said shock absorbing pad covering at least a portion of the wrist including a portion of the triquetrum, hamate, and capitate of said human hand.

4. The glove of claim 1, said shock absorbing pad being above the radiocarpal joint of the wrist.

5. The glove of claim 1, said shock absorbing pad being approximately 4 cms below the center axis of rotation of said metacarpalphalangeal joints.

6. The glove of claim 1, said covering including an outer covering and an inner covering, said shock absorbing pad being disposed between said outer sand said inner covering.

7. In combination with a glove for receiving a human hand therein, the improvement comprising:

a shock absorbing pad covering a portion of the palm of the hand and being of generally trapezoidal shape positioned for location below the center axis of rotation of the metacarpalphalangeal joints and overlying the proximal ends of the metacarpals and carpometacarpal joints of the long finger, the ring finger, and the small finger of the hand, the shock absorbing pad having a distal edge that extends just above the proximal ends of the metacarpals, of the long finger, the ring finger, and the small finger.

8. The combination of claim 7 wherein the trapezium, trapezoid and scaphoid of said human hand are absent of said shock absorbing pad.

9. The combination of claim 7, said shock absorbing pad covering at least a portion of the wrist including a portion of the triquetrum, hamate and capitate of said human hand.

10. The combination of claim 7, said shock absorbing pad being above the radiocarpal joint of the wrist.

11. The combination of claim 7, said shock absorbing pad being approximately 4 cms below the center axis of rotation of said metacarpalphalangeal joints.

* * * * *

UNITED STATES PATENT AND TRADEMARK OFFICE

CERTIFICATE OF CORRECTION

PATENT NO. : 7,003,806 B1
APPLICATION NO. : 10/847187
DATED : February 28, 2006
INVENTOR(S) : Kleinert et al.

It is certified that error appears in the above-identified patent and that said Letters Patent is hereby corrected as shown below:

Column 1, line 44, change “anatomically” to -- anatomical-- ;
Column 1, line 53, change “advantage” to -- advantages --;
Column 3, line 17, change “enclose” to -- enclosing --;
Column 3, line 21 “carpalmetacarpal” to -- carpometacarpal --;
Column 3, line 22 “55” to -- 66 --;
Column 3, line 26 “36” to -- 86 --;
Column 4, Claim 6, delete “sand” and insert -- and --; and
Column 4, Claim 6, delete “covering” and insert -- coverings --.

Signed and Sealed this

Fifteenth Day of May, 2007

JON W. DUDAS
*Director of the United States Patent and Trademark Office*